US008616691B2

(12) United States Patent
Duffield et al.

(10) Patent No.: US 8,616,691 B2
(45) Date of Patent: Dec. 31, 2013

(54) GAS REMOVAL FROM A FLUID DELIVERY SYSTEM

(75) Inventors: John Duffield, Meredith, NH (US); Chris Porter, Meredith, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 211 days.

(21) Appl. No.: 13/301,477

(22) Filed: Nov. 21, 2011

(65) Prior Publication Data

US 2013/0127936 A1 May 23, 2013

(51) Int. Cl.
*B41J 2/165* (2006.01)
*B41J 2/175* (2006.01)

(52) U.S. Cl.
USPC ..... 347/92; 347/85

(58) Field of Classification Search
CPC ..... B41J 2/155; B41J 2/1404
USPC ..... 347/6, 7, 84, 85, 92, 94
See application file for complete search history.

(56) References Cited

U.S. PATENT DOCUMENTS

| | | | | |
|---|---|---|---|---|
| 4,575,738 | A | 3/1986 | Sheufelt et al. | |
| 4,658,268 | A | 4/1987 | Needham et al. | |
| 6,040,927 | A | 3/2000 | Winter et al. | |
| 6,478,417 | B2 | 11/2002 | Hoen et al. | |
| 6,572,214 | B2 | 6/2003 | Otis, Jr. et al. | |
| 7,625,080 | B2 * | 12/2009 | Hess et al. | 347/92 |
| 8,348,406 | B2 * | 1/2013 | Park | 347/89 |
| 2003/0210298 | A1 | 11/2003 | Madeley et al. | |
| 2009/0322831 | A1 | 12/2009 | Emerton et al. | |

* cited by examiner

*Primary Examiner* — An Do
(74) *Attorney, Agent, or Firm* — Michael A. Glenn; Perkins Coie LLP

(57) ABSTRACT

Systems and methods of automatically bleeding air from a primary ink delivery system, so little or no air is mixed with the ink once it reaches a secondary ink system containing print heads. An air bleeder return assembly with a flow restrictor orifice that is configured to remove air from ink pumped to the carriage of print heads, thereby minimizing jet dropouts. Additionally, this setup provides the added advantage of the ability to run the bulk bags dry without ingesting large quantities of air to the ink delivery system.

29 Claims, 8 Drawing Sheets

GAS REMOVAL FROM A FLUID DELIVERY SYSTEM

BACKGROUND OF THE INVENTION

1. Technical Field

The invention relates to the field of inkjet printing. More specifically the invention relates to systems for automatically bleeding air from an ink delivery system.

2. Description of the Related Art

Inkjet printing involves depositing droplets of liquid ink onto a printing medium from one or more printer heads. The printer heads are coupled with a container containing ink. Ink is ejected from one or more nozzles of the print heads when a piezoelectric crystal in the print head is actuated. The piezoelectric crystal generates a pulse in the ink so that the ink expels through the nozzle as a droplet. To create the image, a carriage which holds one or more print heads scans or traverses across the printing medium, while the print heads deposit ink as the printing medium moves.

Small desktop inkjet printers are common consumer electronic products. Indeed, many consumer and business printing needs may be met by small desktop inkjet printing systems because of the relatively small amount of ink needed for common print jobs. However, some printing applications require much larger amounts of ink. For instance, large format printing is performed to create signs, banners, museum displays, sails, bus boards and the like. These types of applications require large throughput printers and require a much larger quantity of ink.

Ink cartridges are typically sold with replaceable ink reservoirs. Most commonly, these ink reservoirs are individually packaged and sold over the counter. However, common inkjet reservoirs contain far less ink than is required for large format printing. Currently, replacement reservoirs are not available in volumes greater than approximately five liters. Furthermore, the overhead cost associated with individually manufacturing, packaging and shipping small, individual replacement reservoirs is burdensome given that they must be replaced frequently to achieve large format printing. Accordingly, many print applications benefit from bulk ink supply systems.

Typical bulk ink supply systems for inkjet printers involve supplying the print head of the inkjet printer with ink from a bulk reservoir remote from the print head via ink lines. Some approaches in bulk ink supply involve a gravity feed, capillary feed, siphons or other mechanisms, instead of active electrical/mechanical devices, to transfer ink to the printing head. However, gravity feed ink delivery systems have inherent limitations, as their use often results in ink starvation or flooding at the printing head. These phenomena occur because the level of the ink immediately adjacent to the printing head is insufficiently maintained either due to limitations of the feed system or the need to manually adjust and replenish the ink reserves.

Other approaches to bulk ink delivery system involve a pump configured to suck ink from the bulk reservoir through a filter to the print heads via supply lines. However, sucking ink through a filter creates microbubbles that are mixed into the ink. Another drawback to this conventional approach using a pump system is that once a reservoir is run dry the pump begins to pump air into the supply lines. Additionally, even if the reservoir is changed before it become dry, the supply lines become de-primed when an operator changes the bulk reservoir, thereby introducing air into the system.

Indeed, the presence of air in an inject system is problematic. For example, if air is present in the ink chamber within the print head, intended pressure changes resulting from piezoelectric deformation of part of the ink chamber walls will be absorbed by the air, leaving the ink pressure unaffected. The surface tension force of the ink in the nozzle maintains the meniscus and fewer or no drops will be ejected from the ink chamber or the drops will be misdirected.

Previous attempts to limit the presence of ink involve the use of an air trap, utilizing a float to shut the air exit off once the air is removed. However, the air trap has moving parts, is expensive, bulky and is not always reliable.

Accordingly, there is a need for a system of using bulk ink reservoirs to supply an inkjet system in which air is not mixed with the ink that is pumped to the print heads which is reliable and commercially feasible.

SUMMARY OF THE INVENTION

In view of the foregoing, the invention provides systems and methods of automatically bleeding air from a primary ink delivery system, so little or no air is mixed with the ink once it reaches a secondary ink system containing print heads.

Some embodiments of the invention involve a bulk ink delivery system having a plurality of bulk ink containers coupled with primary ink delivery modules for delivering ink from the containers is to the print head carriage. In some embodiments of the invention, the ink delivery system comprises ink containers containing ink defining the CYMK color space, or a variant of the CYMK color space, i.e. light yellow, cyan, light magenta, black, light black, magenta, light cyan, and yellow.

The presently preferred embodiments of the invention involve an air bleeder return assembly with a flow restrictor orifice that is configured to remove air from ink pumped to the carriage of print heads, thereby minimizing jet dropouts. Additionally, this setup provides the added advantage of the ability to run the bulk bags dry without ingesting large quantities of air to the ink delivery system.

According to these embodiments, a bleed component comprising a primary filter is placed after a pump and the bleed valve of the filter feeds the supply line of the air bleeder return assembly. The air bleeder return assembly includes a flow restrictor orifice that is precisely-sized to allow all the air to flow quickly, but to create enough pressure for the air free ink to be pumped through the primary filter and to the print head carriage.

Some embodiments of the invention involve an air bleeder return assembly comprises a flow restrictor orifice coupled with ink tubes, quick couplings, at least one secondary filter, and other unique fittings to easily couple with a bulk ink container.

Some embodiments of the invention involve a variable-sized orifice and a controller for controlling the orifice size, thereby providing an operator with the ability to tune ink flow rates and ink viscosity while still ensuring proper air removal. In some embodiments of the invention, the controller comprises a processor operatively coupled with a memory, wherein the processor is configured for controlling the orifice size of the variable-sized orifice flow restrictor.

In some embodiments of the invention, the processor is configured to automatically gather data from the ink delivery system via flow meters, $O_2$ sensors, and other sensors commonly used for fluid metering and analysis.

In some other embodiments of the invention, the processor is coupled with a display having a graphical user interface such that a human operator controls the orifice size of the variable-sized orifice flow restrictor to precisely control fluid attributes.

Some other embodiments of the invention involve a method for operating a bulk ink delivery system and for controlling a variable-sized orifice flow restrictor to ensure proper air removal according to some embodiments of the invention.

DETAILED DESCRIPTION OF THE INVENTION

Figure 1:
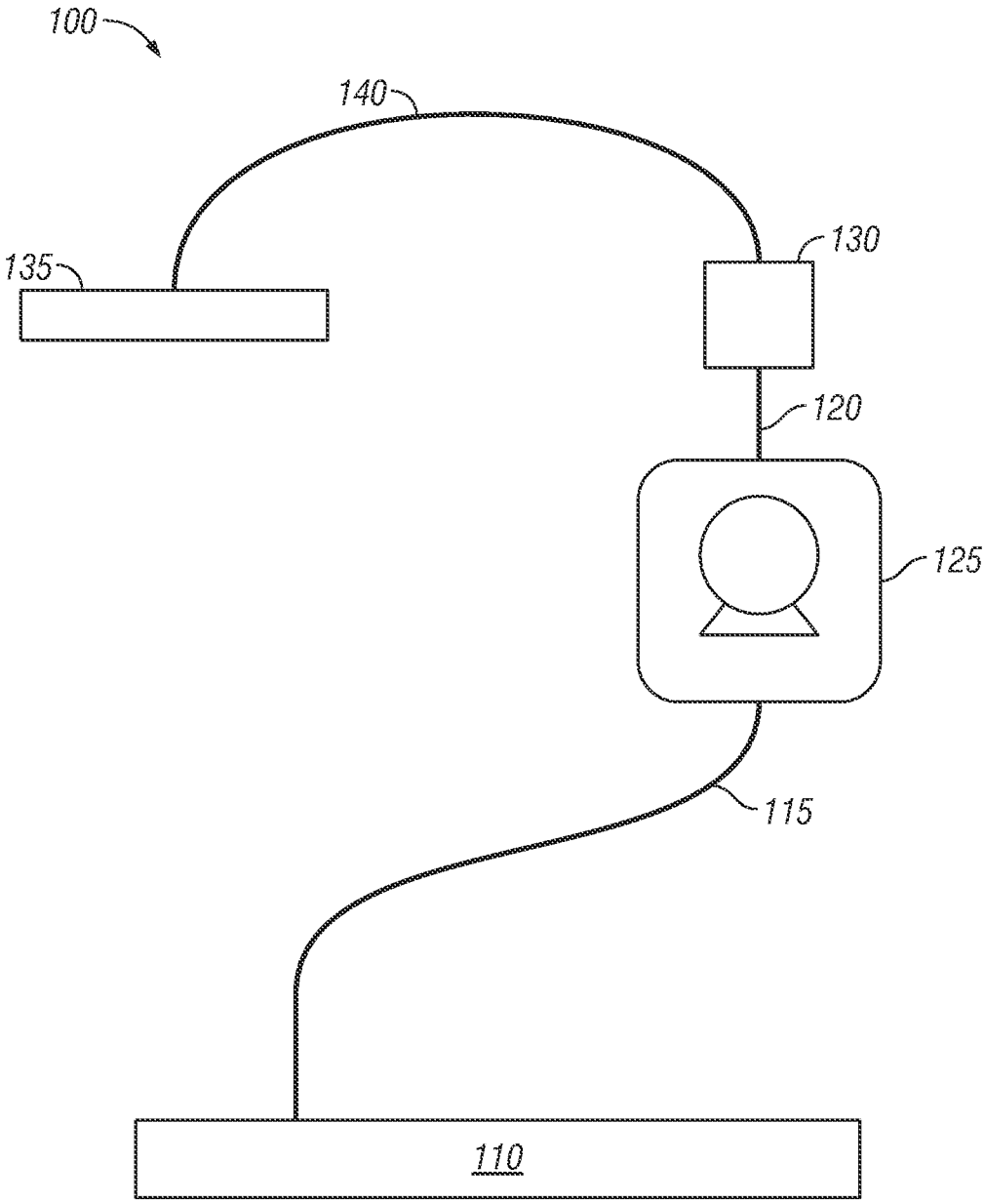
FIG. 1 (Prior Art)
FIG. 1 illustrates a bulk ink delivery system according to the prior art.

As explained above, previous approaches that utilize bulk ink reservoirs involve a pump configured to suck ink from the bulk reservoir through a filter to the print heads via supply lines. FIG. 1 illustrates a bulk ink delivery system 100 according to the prior art. The ink delivery system 100 includes a bulk ink reservoir 110, supply lines 115, 120, 140, a pump 125, a filter 130 and a block of print heads 135. According to FIG. 1, ink is sucked from the ink reservoir 100 by the pump 125, delivered through the supply lines 115, 120, 140, filtered by the filter 130, and delivered to the block of print heads 135. However, sucking ink through the filter 130 creates air bubbles in the ink. Likewise, once the ink reservoir is emptied, air is sucked into the block of print heads 135.

The invention introduces a primary ink system in fluid communication with a secondary ink system, wherein the primary ink system is configured to automatically bleed air from the system, so little or no air is mixed with the ink once it reaches the secondary ink system.

Figure 2A:
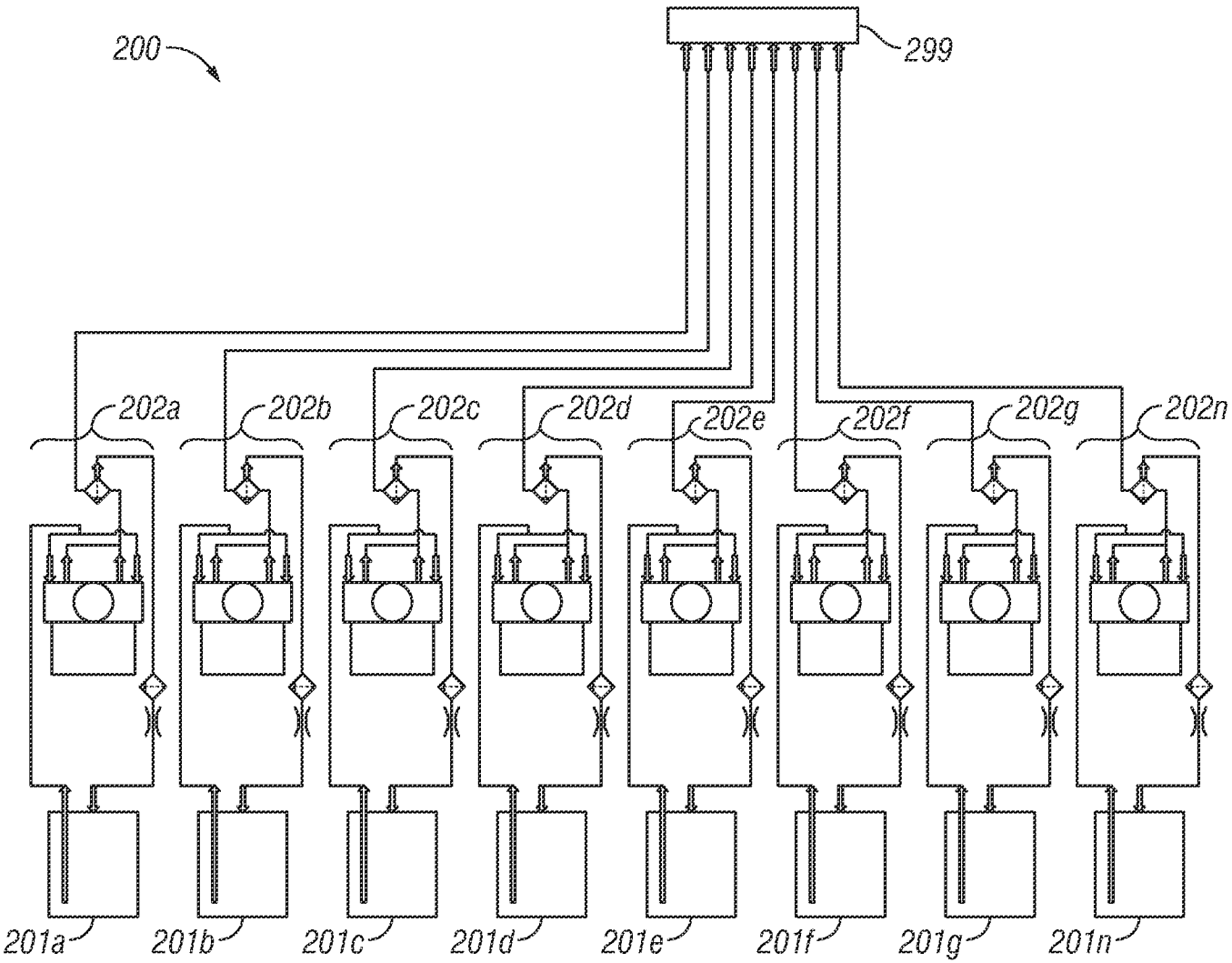
FIG. 2A illustrates schematic representation of an ink delivery system according to some embodiments of the invention.

FIG. 2A illustrates schematic representation of a bulk ink delivery system 200 according to some embodiments of the invention. The bulk ink delivery system 200 includes a plurality of bulk ink containers 201*a*, 201*b*, 201*c*, 201*d*, 201*e*, 201*f*, 201*g*, and 201*n*.

According to FIG. 2A, ink from the containers is delivered to the print head carriage 299 via a plurality of primary ink delivery modules 202*a*, 202*b*, 202*c*, 202*d*, 202*e*, 202*f*, 202*g*, and 202*n*.

In the presently preferred embodiments of the invention, the ink delivery system 200 comprises ink containers containing ink defining the CYMK color space, or a variant of the CYMK color space, i.e. light yellow, cyan, light magenta, black, light black, magenta, light cyan, and yellow.

Figure 2B:
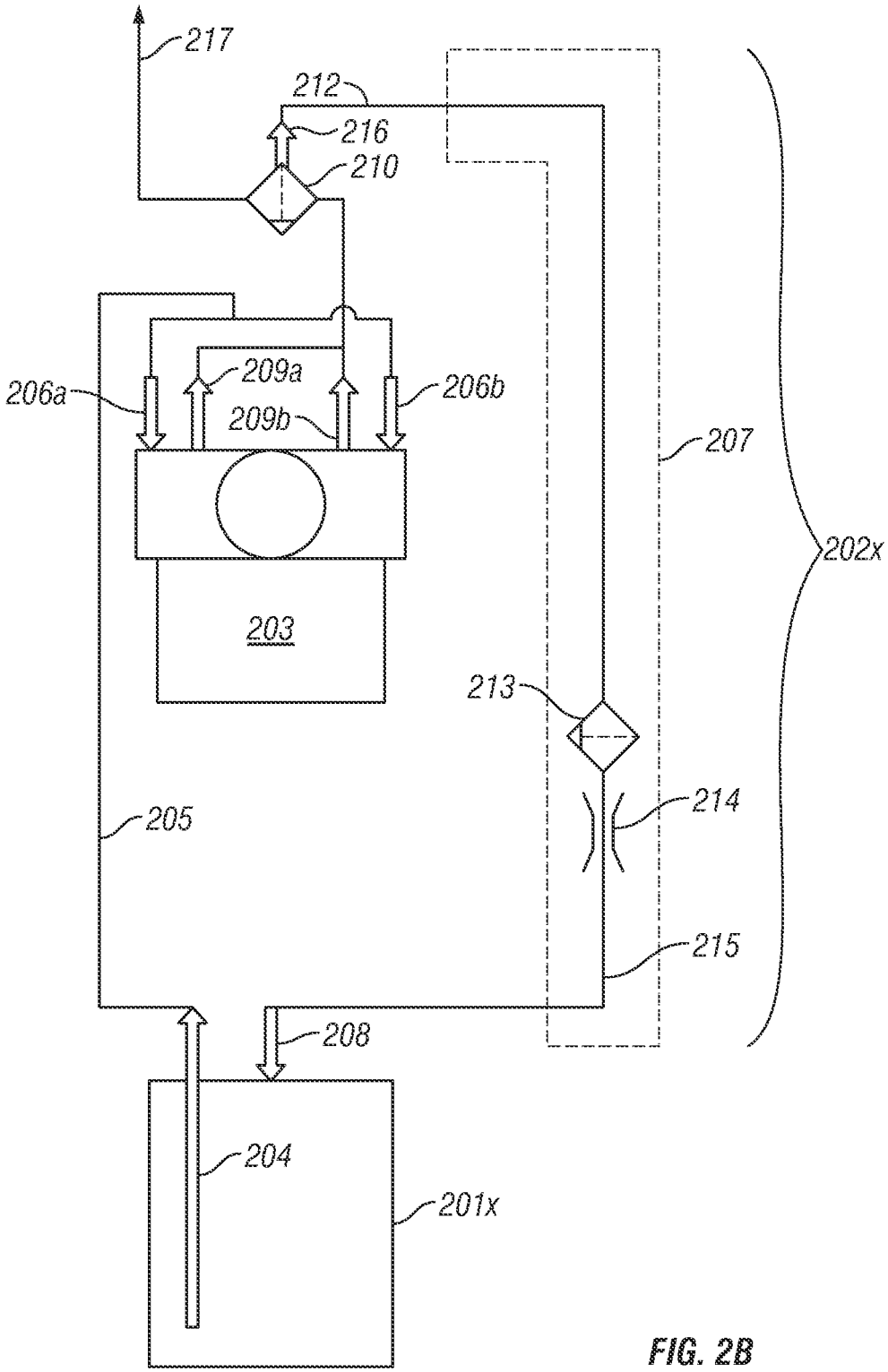
FIG. 2B illustrates schematic detail representation of an individual bulk ink container and an individual primary ink delivery module according to some embodiments of the invention.

FIG. 2B illustrates schematic detail representation of an individual bulk ink container 201*x* and an individual primary ink delivery module 202*x* according to some embodiments of the invention.

The ink container 201*x* is in fluid communication with a pump 203 via a draw tube 204, supply line 205, and pump inlet valves 206*a*, 206*b*. Likewise, the ink container 201*x* is in fluid communication with an air bleeder return assembly 207 (boxed with dotted lines) via air pressure intake line 208. In operation, fluid, comprising a mixture of ink and air, is pumped out of the pump 203 via outlet valves 209*a*, 209*b*, through a primary filter 210, and into the air bleeder return assembly 207. The air bleeder return assembly 207 comprises a supply line 212, secondary filter 213, flow restrictor orifice 214, and supply line 215.

The primary filter 210 comprises a filter with a bleed valve 216. According to prior approaches, the filter is located in-line, before the pump and the bleed valve is capped, blocked with a bleed screw, or nonexistant.

However, according to the preferred embodiments of the invention, the primary filter 210 is placed after the pump 203 and the bleed valve 216 feeds the supply line 212 of the air bleeder return assembly 207. As explained above, the air bleeder return assembly 207 includes a flow restrictor orifice 214 which connects the bleed valve 216 back to the bulk ink container 201*x*.

The flow restrictor orifice 214 is precisely-sized to allow all the air to flow quickly, but to create enough pressure for the air free ink to be pumped through the primary filter 210 and to the print head carriage 299 via supply line 217.

Positioning the primary filter 210 and the air bleeder return assembly 207 in this fashion allows clean ink, free from air bubbles to be pumped to the carriage 299, minimizing jet dropouts, ink misdirection, and other defects that affect print quality. Additionally, this setup provides the added advantage of the ability to run the bulk bags dry without ingesting large quantities of air to the ink delivery system.

Positioning the bleed valve 216 and flow restrictor orifice 214 on the up side of the primary filter 210 allows particulates through that could clog the flow restrictor orifice 214; therefore, the secondary filter 213 is placed prior to flow restrictor orifice 214. In the presently preferred embodiments of the invention, the secondary filter 213 comprises a screen filter.

Figure 2C:
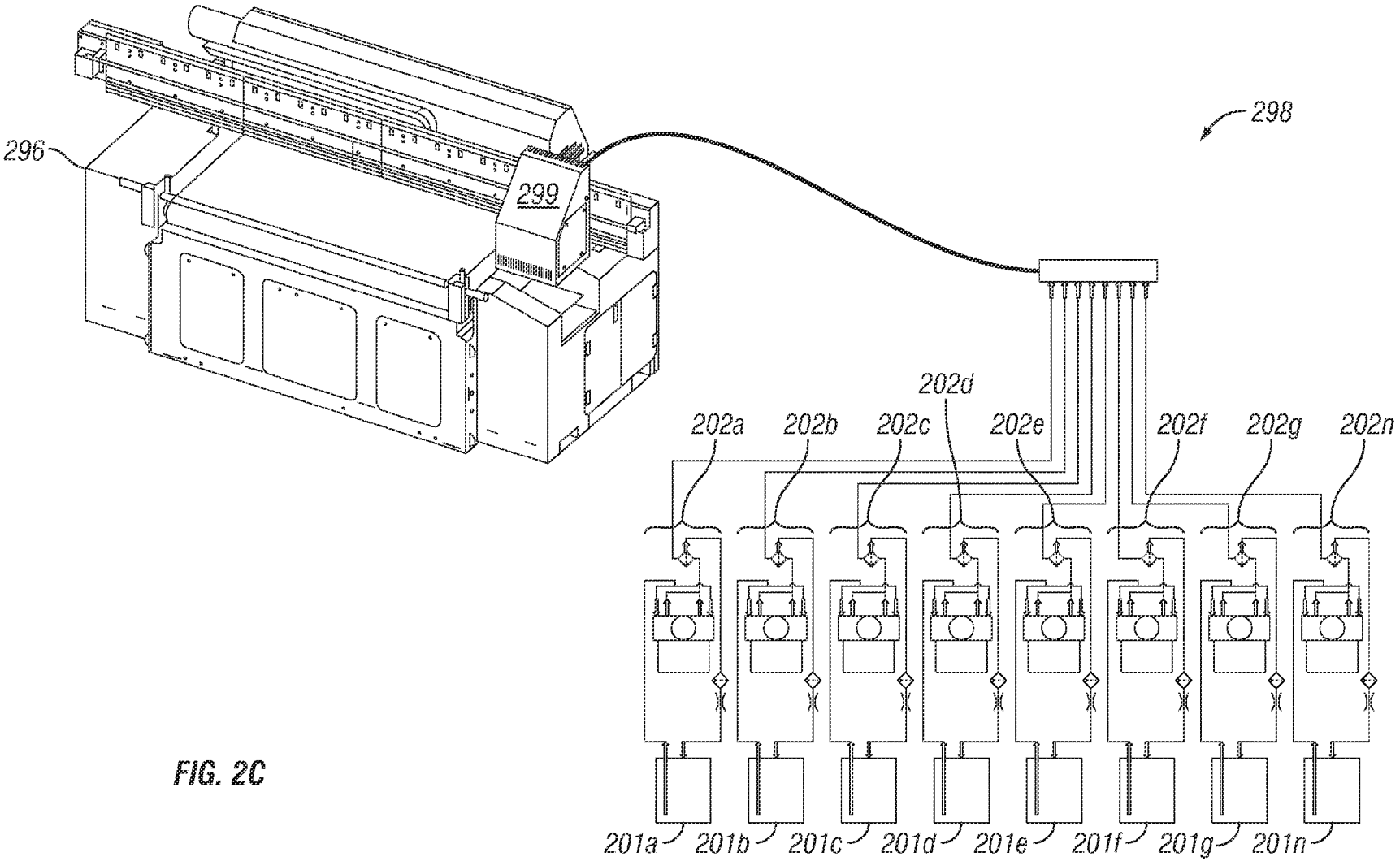
FIG. 2C illustrates an isometric representation of a printer system comprising a plurality of primary ink delivery modules for delivering ink to printer according to some embodiments of the invention.

FIG. 2C illustrates an isometric representation of a printer system 298 comprising a plurality of primary ink delivery modules 202*a*, 202*b*, 202*c*, 202*d*, 202*e*, 202*f*, 202*g*, and 202*n* for delivering ink to printer 296 according to some embodiments of the invention.

The printer system 298 includes a plurality of bulk ink containers 201*a*, 201*b*, 201*c*, 201*d*, 201*e*, 201*f*, 201*g*, and 201*n* configured for delivering ink to a print head carriage 299 of the printer 296. In the presently preferred embodiments of the invention, the printer 296 comprises a piezoelectric printer with a print head carriage 299 containing ink heads defining the CYMK color space, or a variant of the CYMK color space, i.e. light yellow, cyan, light magenta, black, light black, magenta, light cyan, and yellow.

Figure 3:
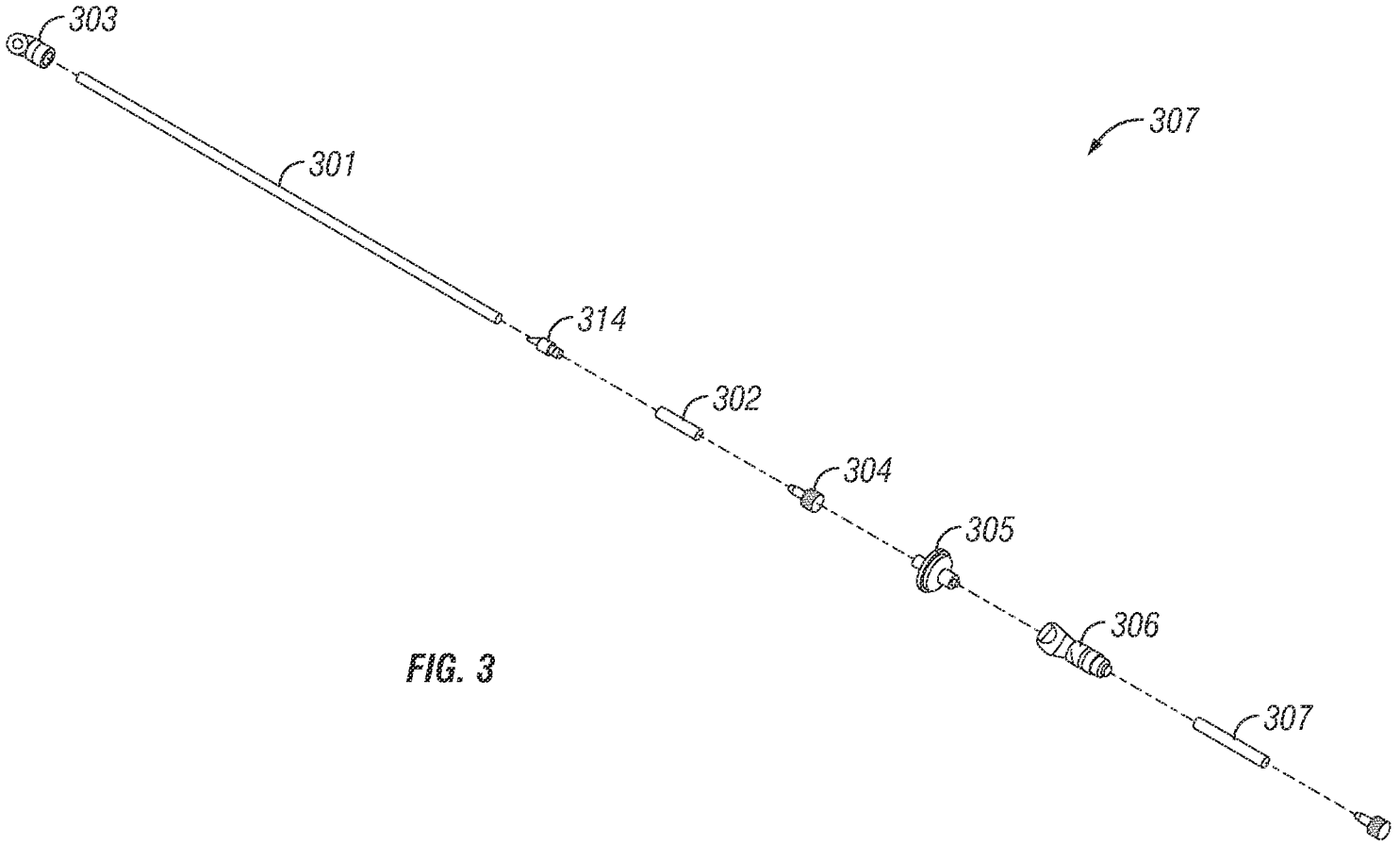
FIG. 3 illustrates an exploded view of the air bleeder return assembly according to some embodiments of the invention.

FIG. 3 illustrates an exploded view of an air bleeder return assembly 307 according to some embodiments of the invention. The air bleeder return assembly 307 comprises a flow restrictor orifice 314 coupled with ink tubes 301, 302. Ink tube 301 terminates with a quick coupling 303 chosen to couple with the supply line (shown in FIG. 2B) and bleed valve (shown in FIG. 2B) from the primary filter (shown in FIG. 2B). Ink tube 302 is coupled with a filter 305 via a quick coupling 304. Likewise, the filter 305 is coupled with another ink tube 307 via another quick coupling 306. Ink tube 307 terminates with a fitting 308 to couple with a bulk ink container.

As explained above in reference to FIG. 2B, the flow restrictor orifice 214 is precisely-sized to allow all the air to flow quickly, but to create enough pressure for the air free ink to be pumped through the primary filter 210 and to the print head carriage 299.

Another aspect of the invention involves a variable-sized orifice and a controller for controlling the orifice size, thereby providing an operator with the ability to tune ink flow rates and ink viscosity while still ensuring proper air removal.

Figure 4:
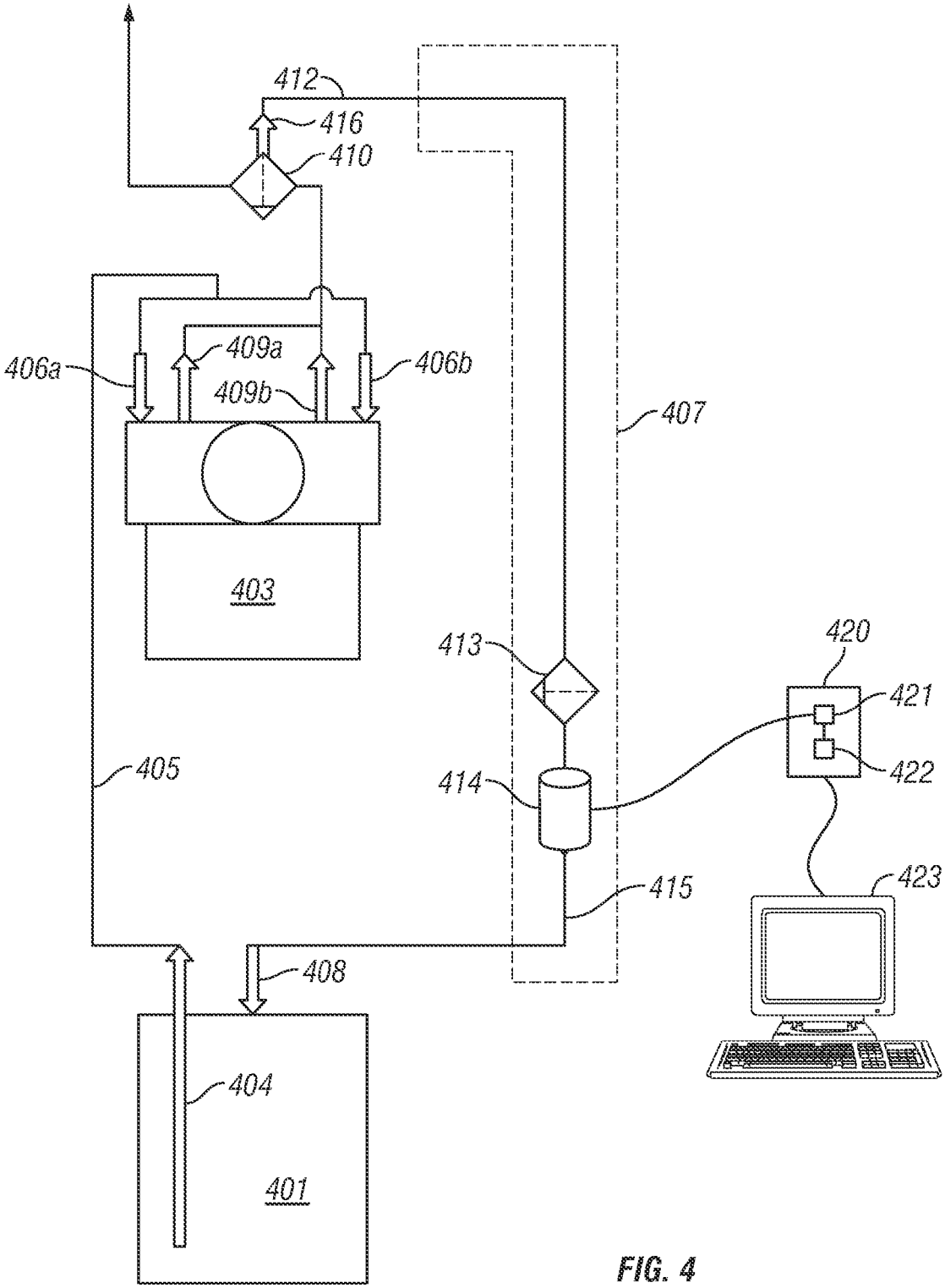
FIG. 4 illustrates schematic detail representation of an individual bulk ink container and an individual primary ink delivery module with variable-sized orifice according to some embodiments of the invention.

FIG. 4 illustrates schematic detail representation of a ink delivery system 400 comprising a bulk ink container 401, a primary ink delivery module 402 with variable-sized orifice, and a controller 403 according to some embodiments of the invention.

According to FIG. 4, the ink container 401 is in fluid communication with a pump 403 via a draw tube 404, a supply line 405, and pump inlet valves 406*a*, 406*b*. Likewise, the ink container 401 is in fluid communication with a variable-sized orifice air bleeder return assembly 407 (boxed with dotted lines) via air pressure intake line 408.

Additionally, a mixture of ink and air is pumped out of the pump 403 via outlet valves 409*a*, 409*b*, through a primary filter 410 with a bleed valve 416, and into the air bleeder return assembly 407. The variable-sized orifice air bleeder return assembly 407 comprises a supply line 412, secondary filter 413, a variable-sized orifice flow restrictor 414, and a supply line 415. The variable-sized orifice flow restrictor 414 is coupled with a controller 420.

In the preferred embodiments of the invention, the controller 420 comprises a processor 421 operatively coupled with a memory 422, wherein the processor 421 is configured for controlling the orifice size of the variable-sized orifice flow restrictor 414. In some embodiments of the invention, the processor 421 is configured to automatically gather data from the ink delivery system 400 via flow meters, $O_2$ sensors, and other sensors commonly used for fluid metering and analysis by those having ordinary skill in the art.

In some other embodiments of the invention, the processor 421 is coupled with a display 423 having a graphical user interface. According to these embodiments, a human operator controls the orifice size of the variable-sized orifice flow restrictor 414 to precisely control fluid attributes.

Figure 5:
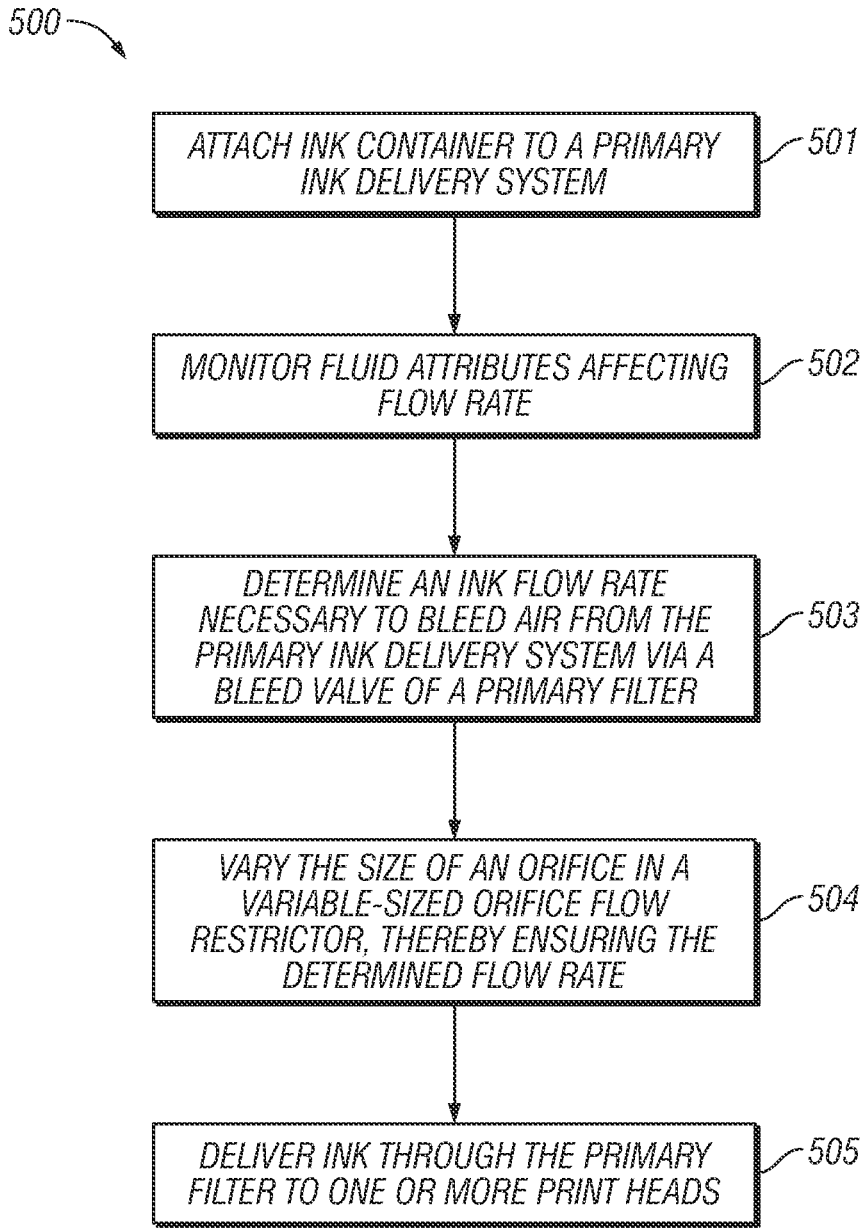
FIG. 5 illustrates a method for operating a bulk ink delivery system and for controlling a variable-sized orifice flow restrictor to ensure proper air removal according to some embodiments of the invention.

FIG. 5 illustrates a method 500 for operating a bulk ink delivery system and for controlling a variable-sized orifice flow restrictor to ensure proper air removal according to some embodiments of the invention. The method 500 begins by coupling a bulk ink container to a primary ink delivery system 501. Next, a controller monitors fluid attributes in the ink container 502 that affect flow rate. The controller determines an ink flow rate necessary to bleed air from the primary ink delivery system via a bleed valve of a primary filter 503. Next, the controller varies the size of an orifice in a variable-sized orifice flow restrictor, thereby ensuring the determined flow rate 504. Finally, ink is delivered through the primary filter to one or more print heads 505.

Figure 6:
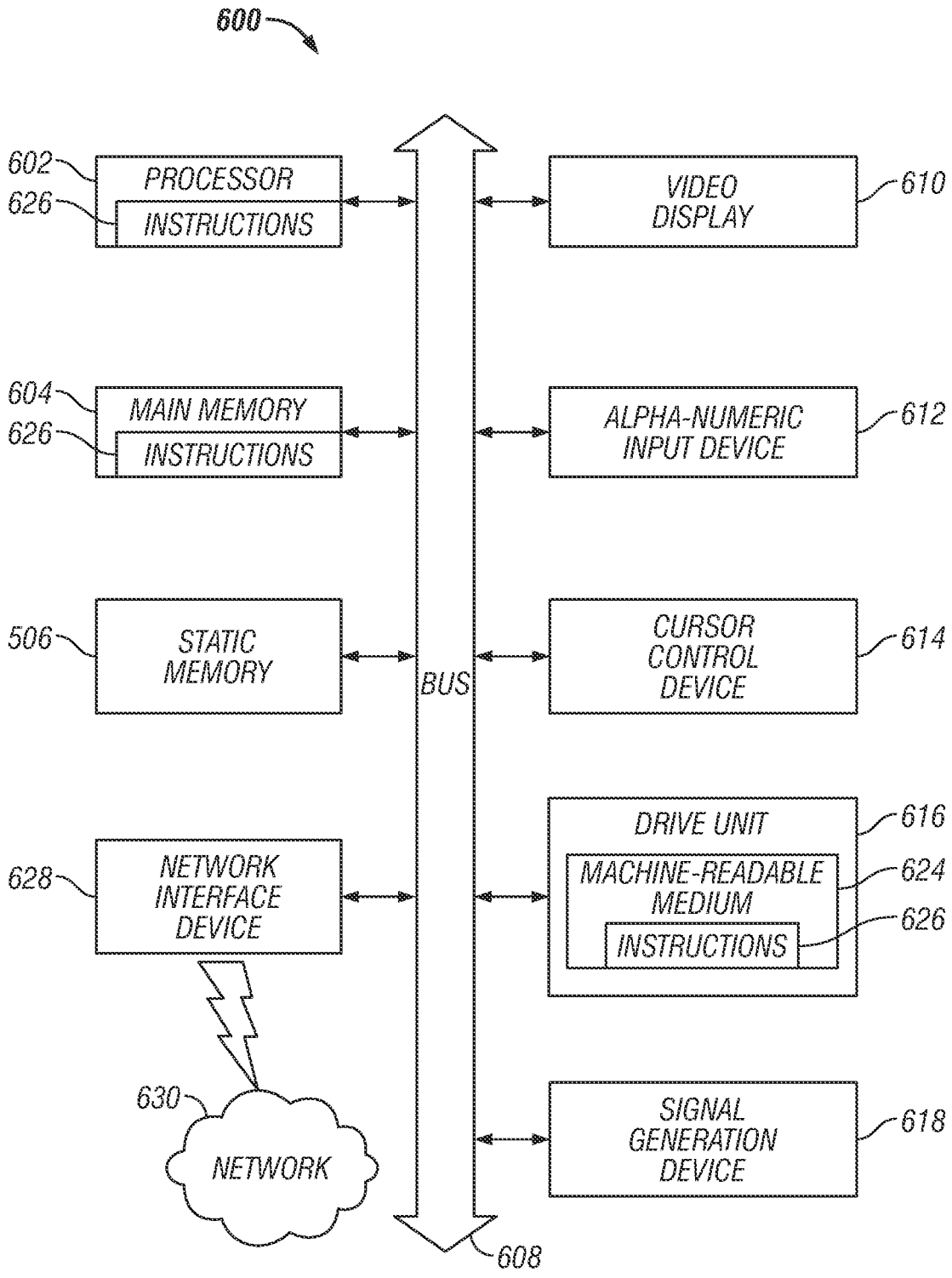
FIG. 6 is a block schematic diagram of a machine in the exemplary form of a computer system within which a set of instructions may be programmed to cause the machine to execute the logic steps of the invention.

FIG. 6 is a block schematic diagram of a machine in the exemplary form of a computer system 600 within which a set of instructions may be programmed to cause the machine to execute the logic steps of the invention. In alternative embodiments, the machine may comprise a network router, a network switch, a network bridge, personal digital assistant (PDA), a cellular telephone, a Web appliance or any machine capable of executing a sequence of instructions that specify actions to be taken by that machine.

The computer system 600 includes a processor 602, a main memory 604 and a static memory 606, which communicate with each other via a bus 608. The computer system 600 may further include a display unit 610, for example, a liquid crystal display (LCD) or a cathode ray tube (CRT). The computer system 600 also includes an alphanumeric input device 612, for example, a keyboard; a cursor control device 614, for example, a mouse; a disk drive unit 616, a signal generation device 618, for example, a speaker, and a network interface device 620.

The disk drive unit 616 includes a machine-readable medium 624 on which is stored a set of executable instructions, i.e. software, 626 embodying any one, or all, of the methodologies described herein below. The software 626 is also shown to reside, completely or at least partially, within the main memory 604 and/or within the processor 602. The software 626 may further be transmitted or received over a network 628, 630 by means of a network interface device 620.

In contrast to the system 600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complimentary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g. a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention described herein with reference to the preferred embodiments, one skilled in the art will readily appreciate that other applications may be substituted for those set forth herein without departing from the spirit and scope of the invention. Accordingly, the invention should only be limited by the Claims included below.

The invention claimed is:

1. A printing system comprising:

an inkjet printer comprising a plurality of print heads for respectively jetting a plurality of color inks onto a recording medium;

a plurality of bulk ink containers storing liquid inks of various colors, wherein the totality of the various colors define a color model;

a plurality of primary ink delivery modules configured for individually delivering individually-colored inks to each of the plurality of print heads, wherein each of the primary ink delivery modules further comprise:

a pump configured to draw a fluid from an individual bulk ink container, wherein said fluid comprises ink and at least a portion of gas mixed with said ink;

at least one pump outlet configured for pushing said fluid to a bleed component; and an air bleeder assembly with a first terminal end coupled with said bleed valve via a supply line and a second terminal end coupled with said bulk ink container, wherein said air bleeder assembly further comprises a flow restrictor orifice precisely-sized to allow said gas to flow back to said individual bulk ink container and to create enough pressure for gas-free ink to be pumped through the bleed component and to a print head via said pump outlet.

2. The printing system of claim 1, wherein the plurality of bulk ink containers store liquid inks defining a color model including colors consisting of light yellow, cyan, light magenta, black, light black, magenta, light cyan, and yellow.

3. The printing system of claim 1, wherein the air bleeder assembly further comprises a secondary filter positioned upstream from said flow restrictor orifice.

4. The printing system of claim 3, wherein the secondary filter comprises a screen filter.

5. The printing system of claim 1, wherein the pump is configured to draw fluid via a draw tube and at least one pump intake.

6. The printing system of claim 1, wherein the bleed component comprises a primary filter comprising a filter, a filter outlet, and a bleed valve.

7. A method of preventing gas from entering a print head carriage comprising the steps of:

coupling individual bulk ink containers from among a plurality of bulk ink containers to individual print heads in an inkjet printer carriage, wherein said individual bulk ink containers contain liquid inks of various colors, wherein the totality of the various colors define a color model;

coupling individual ink delivery modules with each of said individual bulk ink containers and with individual print heads in a print head carriage, further comprising:

configuring each individual ink delivery module with a pump configured to draw a fluid from each individual bulk ink container, wherein said fluid comprises ink and at least a portion of gas mixed with said ink;

configuring each individual ink delivery module with a pump outlet configured for pushing said fluid to a bleed component;

configuring each individual ink delivery module with an air bleeder assembly having a first terminal end coupled with said bleed valve via a supply line and a second terminal end coupled with said bulk ink container; and configuring said air bleeder assembly with a flow restrictor orifice for allowing said gas to flow back to said individual bulk ink container and configured to create enough pressure for gas-free ink to be pumped through the bleed component and to a print head via said pump outlet;

wherein each individual ink delivery module individually delivers individually-colored inks to each of the plurality of print heads.

8. The method of claim 7, further comprising precisely choosing the size of said flow restrictor orifice to allow said gas to flow back to said individual bulk ink container and to create enough pressure for gas-free ink to be pumped through the primary filter for an ink having a particular viscosity.

9. The method of claim 7, wherein the step of configuring said air bleeder assembly further comprises coupling a variable flow restrictor orifice with said air bleeder assembly.

10. The method of claim 9, further comprising:

coupling a controller to said variable flow restrictor orifice, wherein said controller comprises a processor and memory.

11. The method of claim 10, further comprising:

coupling said controller with a display; and configuring said processor to display a graphical user interface to an operator, wherein said graphical user interface is configured to allow said operator to control the flow through said variable flow restrictor orifice.

12. The method of claim 9, further comprising:

coupling at least one ink attribute sensor with at least one individual ink delivery module;

coupling said at least one ink attribute sensor is coupled with said controller;

configuring said processor to automatically control the flow through said variable flow restrictor orifice based on ink attributes sensed by said at least one ink attribute sensor.

13. The method of claim 7, wherein the bleed component comprises a primary filter comprising a filter, a filter outlet, and a bleed valve.

14. The method of claim 7, wherein the pump draws fluid via a draw tube and at least one pump intake.

15. A computer-readable medium containing instructions that, when executed by a processor, are configured for performing the method of claim 7.

16. A primary ink delivery module comprising:

a bulk ink container containing ink for delivery to a print head;

a pump configured to draw a fluid from said bulk ink container, wherein said fluid comprises ink and at least a portion of gas mixed with said ink;

at least one pump outlet configured for pushing said fluid to a bleed component; and an air bleeder assembly with a first terminal end coupled with said bleed valve via a supply line and a second terminal end coupled with said bulk ink container, wherein said air bleeder assembly further comprises a flow restrictor orifice precisely-sized to allow said gas to flow back to said individual bulk ink container and to create enough pressure for gas-free ink to be pumped through the bleed component and to a print head via said pump outlet.

17. The primary ink delivery module of claim 16, wherein the bleed component comprises a primary filter comprising a filter, a filter outlet, and a bleed valve.

18. The primary ink delivery module of claim 16, wherein the pump is configured to draw fluid via a draw tube and at least one pump intake.

19. The primary ink delivery module of claim 16, wherein the bulk ink containers stores liquid inks selected from among a group of inks consisting of light yellow ink, cyan ink, light magenta ink, black ink, light black ink, magenta ink, light cyan ink, and yellow ink.

20. The primary ink delivery module of claim 16, wherein the air bleeder assembly further comprises a secondary filter positioned upstream from said flow restrictor orifice.

21. The primary ink delivery module of claim 20, wherein the secondary filter comprises a screen filter.

22. A primary ink delivery module comprising:

a bulk ink container containing ink for delivery to a print heads;

a pump configured to draw a fluid from said bulk ink container, wherein said fluid comprises ink and at least a portion of gas mixed with said ink;

at least one pump outlet configured for pushing said fluid to a bleed component;

an air bleeder assembly with a first terminal end coupled with said bleed valve via a supply line and a second terminal end coupled with said bulk ink container, wherein said air bleeder assembly further comprises a variable flow restrictor orifice; and a controller coupled with said variable flow restrictor, wherein said controller comprises a processor and memory.

23. The primary ink delivery module of claim 22, wherein the bleed component comprises a primary filter comprising a filter, a filter outlet, and a bleed valve.

24. The primary ink delivery module of claim 22, wherein the pump is configured to draw fluid via a draw tube and at least one pump intake.

25. The primary ink delivery module of claim 22, further comprising:

a display coupled with said controller; and wherein said processor is configured to display a graphical user interface to an operator, wherein said graphical user interface is configured to allow said operator to control the flow through said variable flow restrictor orifice.

26. The primary ink delivery module of claim 22, further comprising at least one ink attribute sensor coupled with said supply line and coupled with said controller, wherein said at least one ink attribute sensor is configured to sense at least one ink attribute;

wherein said processor is configured to automatically control the flow through said variable flow restrictor orifice based on ink attributes sensed by said at least one ink attribute sensor.

27. The primary ink delivery module of claim 26, wherein said at least one ink attribute comprises ink viscosity.

28. The primary ink delivery module of claim 22, wherein the air bleeder assembly further comprises a secondary filter positioned upstream from said flow restrictor orifice.

29. A printing system comprising:

an inkjet printer comprising at least one print head for jetting ink onto a recording medium;

at least one bulk ink container for storing liquid ink;

a pump configured to draw a fluid from said at least one bulk ink container, wherein said fluid comprises ink and at least a portion of gas mixed with said ink;

at least one pump outlet configured for pushing said fluid to a bleed component; and an air bleeder assembly with a first terminal end coupled with said bleed valve via a supply line and a second terminal end coupled with said bulk ink container, wherein said air bleeder assembly further comprises a flow restrictor orifice precisely-sized to allow said gas to flow back to said individual bulk ink container and to create enough pressure for gas-free ink to be pumped through the bleed component and to a print head via said pump outlet.

* * * * *